US011840806B2

(12) United States Patent
Zhao et al.

(10) Patent No.: US 11,840,806 B2
(45) Date of Patent: Dec. 12, 2023

(54) ENVIRONMENTALLY-FRIENDLY METHOD FOR ENHANCING MECHANICAL PROPERTIES OF HIGH ANTIBACTERIAL NANO DIALYSIS PAPER FOR MEDICAL PROTECTION

(71) Applicant: Zhejiang University of Science and Technology, Hangzhou (CN)

(72) Inventors: Huifang Zhao, Hangzhou (CN); Daliang Guo, Hangzhou (CN); Chian Fang, Jinhua (CN); Shouyi Han, Nanyang (CN); Yike Huang, Wenzhou (CN); Liangyu Huang, Taizhou (CN); Gaorong Hu, Dongyang (CN); Yuechen Zhou, Taizhou (CN); Zhiyuan Tu, Jiaxing (CN)

(73) Assignee: Zhejiang University of Science and Technology, Hangzhou (CN)

( * ) Notice: Subject to any disclaimer, the term of this patent is extended or adjusted under 35 U.S.C. 154(b) by 0 days.

(21) Appl. No.: 18/305,311

(22) Filed: Apr. 21, 2023

(65) Prior Publication Data

US 2023/0340727 A1 Oct. 26, 2023

Related U.S. Application Data

(63) Continuation of application No. PCT/CN2023/081245, filed on Mar. 14, 2023.

(30) Foreign Application Priority Data

Apr. 25, 2022 (CN) ..... 202210441844.4

(51) Int. Cl.
*D21F 11/00* (2006.01)
*D21H 13/02* (2006.01)
*D21H 27/10* (2006.01)
*D21D 1/02* (2006.01)

(52) U.S. Cl.
CPC ..... *D21F 11/00* (2013.01); *D21D 1/02* (2013.01); *D21H 13/02* (2013.01); *D21H 27/10* (2013.01)

(58) Field of Classification Search
CPC ..... D21F 11/00; D21H 13/02; D21H 27/10; D21D 1/02
USPC ..... 162/141
See application file for complete search history.

(56) References Cited

FOREIGN PATENT DOCUMENTS

| | | | |
|---|---|---|---|
| CN | 109778587 | A | 5/2019 |
| CN | 111608011 | A | 9/2020 |
| CN | 112176770 | A | 1/2021 |
| CN | 112501942 | A | 3/2021 |
| CN | 112761027 | A | 5/2021 |
| CN | 113089373 | A | 7/2021 |
| CN | 113089380 | A | 7/2021 |
| JP | H07150474 | A | 6/1995 |

*Primary Examiner* — Mark Halpern
(74) *Attorney, Agent, or Firm* — Kaplan Breyer Schwarz, LLP; Stuart H. Mayer

(57) ABSTRACT

Disclosed is an environmentally-friendly method for enhancing mechanical properties of a high antibacterial nano dialysis paper for medical protection, includes following steps: a, preparing pulp components, and taking 40-60 parts of hardwood pulp, 10-20 parts of polyvinyl alcohol fiber, 30-50 parts of softwood pulp, 10-20 parts of cellulose fiber by mass; b, putting the hardwood pulp, the polyvinyl alcohol fiber, the softwood pulp and the cellulose fiber into a beater for beating to make a pulp, and then adding modified chitosan accounting for 1-5% of a weight of the pulp into the pulp, and defibering for 10-20 minutes at a rotating speed of 1500-2000 revolutions per minute in a defibrator; and c, carrying out papermaking with the pulp after defibering to form a dialysis paper finished product.

8 Claims, 1 Drawing Sheet

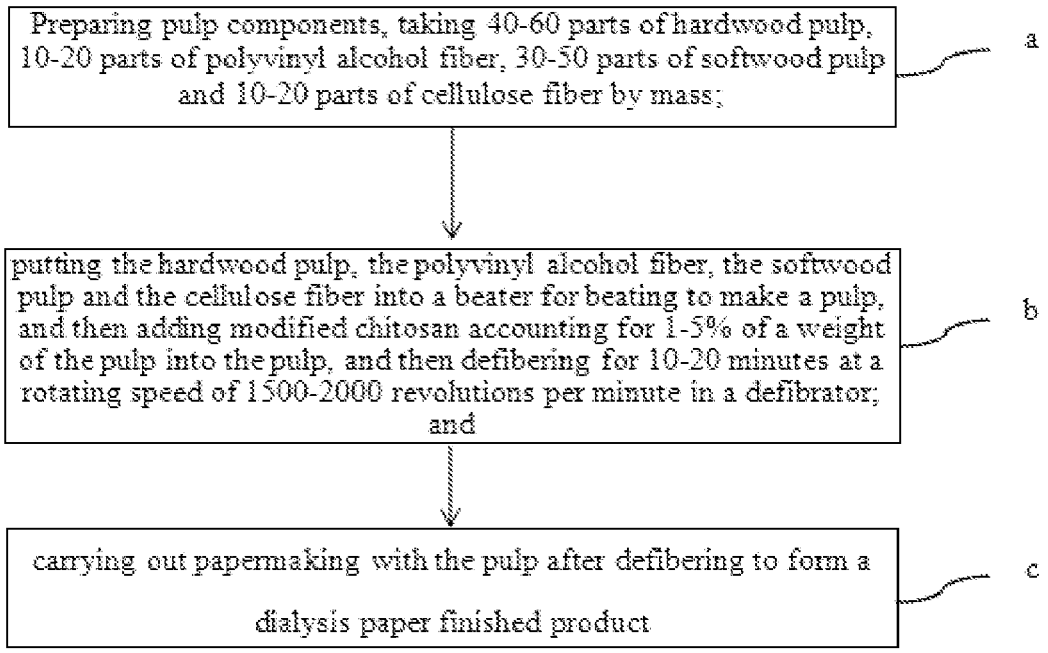
Preparing pulp components, taking 40-60 parts of hardwood pulp, 10-20 parts of polyvinyl alcohol fiber, 30-50 parts of softwood pulp and 10-20 parts of cellulose fiber by mass;
a
putting the hardwood pulp, the polyvinyl alcohol fiber, the softwood pulp and the cellulose fiber into a beater for beating to make a pulp, and then adding modified chitosan accounting for 1-5% of a weight of the pulp into the pulp, and then defibering for 10-20 minutes at a rotating speed of 1500-2000 revolutions per minute in a defibrator; and
b
carrying out papermaking with the pulp after defibering to form a dialysis paper finished product
c

ENVIRONMENTALLY-FRIENDLY METHOD FOR ENHANCING MECHANICAL PROPERTIES OF HIGH ANTIBACTERIAL NANO DIALYSIS PAPER FOR MEDICAL PROTECTION

CROSS-REFERENCE TO RELATED APPLICATIONS

This application claims priority to Chinese Patent Application No. 202210441844.4, filed on Apr. 25, 2022, the contents of which are hereby incorporated by reference.

TECHNICAL FIELD

The application relates to the technical field of preparation of dialysis paper, and in particular to an environmentally-friendly method for enhancing mechanical properties of a high antibacterial nano dialysis paper for medical protection.

BACKGROUND

When a high-temperature sterilization technology is used for dialysis functional paper bags, a strength of fibers and a bonding force between the fibers may be destroyed to varying degrees under a long-term infiltration of high-temperature steam, so a collapse of a three-dimensional network structure formed by fiber construction may be caused and a packaging strength of the sterilized dialysis paper bags may be affected. In addition, for a safety of medical instruments and medical supplies in a process of transportation and storage, dialysis functional papers also need a high physical strength to prevent packaging bags from punctures and ruptures, so the dialysis functional papers need a high dry and wet physical strength. However, a strength of cellulose fibers used currently in domestic products is poor, and the bonding between the fibers mainly depends on a hydrogen bonding force. Steam sterilization and humid storage environments may easily weaken the hydrogen bonding force, thus affecting a strength of paper.

SUMMARY

An objective of the application is to provide an environmentally-friendly method for enhancing mechanical properties of a high antibacterial nano dialysis paper for medical protection. The dialysis paper prepared by the application has good mechanical properties, is degradable, and has a high bacteria resistance and a high air permeability.

According to a technical scheme of the application, the environmentally-friendly method for enhancing the mechanical properties of the high antibacterial nano dialysis paper for the medical protection includes following steps:

a, preparing pulp components, taking 40-60 parts of hardwood pulp, 10-20 parts of polyvinyl alcohol fiber, 30-50 parts of softwood pulp and 10-20 parts of cellulose fiber by mass;

b, putting the hardwood pulp, the polyvinyl alcohol fiber, the softwood pulp and the cellulose fiber into a beater for beating to make a pulp, and then adding modified chitosan accounting for 1-5% of a weight of the pulp into the pulp, and then defibering for 10-20 minutes at a rotating speed of 1500-2000 revolutions per minute in a defibrator; and c, carrying out papermaking with the pulp after defibering to form a dialysis paper finished product.

According to the environmentally-friendly method for enhancing the mechanical properties of the high antibacterial nano dialysis paper for the medical protection, the pulp components include 50 parts of hardwood pulp, 15 parts of polyvinyl alcohol fiber, 40 parts of softwood pulp and 15 parts of cellulose fiber in the step a.

According to the environmentally-friendly method for enhancing the mechanical properties of the high antibacterial nano dialysis paper for the medical protection, a beating duration of the beater is 30-60 minutes, and a beating degree is 30-35° SR in the step b.

According to the environmentally-friendly method for enhancing the mechanical properties of the high antibacterial nano dialysis paper for the medical protection, the modified chitosan is prepared by an N-acylation reaction between maleic anhydride and chitosan under homogeneous conditions.

The environmentally-friendly method for enhancing the mechanical properties of the high antibacterial nano dialysis paper for the medical protection includes: adding 5-10 parts of chitosan to a mixture of 20-40 parts of N,N dimethylformamide and 20-40 parts of anhydrous ethanol by mass at a room temperature, stirring the mixture to dissolve the chitosan, and then adding 5-10 parts of maleic anhydride to the mixture, and finally obtaining a colloidal product by filtering after stirring for 12-15 hours, and washing the colloidal product to obtain the modified chitosan.

The environmentally-friendly method for enhancing the mechanical properties of the high antibacterial nano dialysis paper for the medical protection includes: in the step c, carrying out papermaking with the pulp with a fourdrinier, surface sizing with a sizing agent, and drying to form a finished medical dialysis paper; the sizing agent is a mixture of a neutral size alkylketene dimmer (AKD), a wet strength agent and a retention aid, where a mass percentage of the neutral size AKD is 60%-80%, a mass percentage of the wet strength agent is 10%-20%, and a mass percentage of the retention aid is 10%-20%.

According to the environmentally-friendly method for enhancing the mechanical properties of the high antibacterial nano dialysis paper for the medical protection, the mass percentage of the neutral size AKD in the sizing agent is 70%, the mass percentage of the wet strength agent is 15%, and the mass percentage of the retention aid is 15%.

According to the environmentally-friendly method for enhancing the mechanical properties of the high antibacterial nano dialysis paper for the medical protection, the wet strength agent is polyamide epichlorohydrin, and a solid content is 12.5%.

According to the method for enhancing mechanical properties of nano dialysis paper for medical protection of high-resistance bacteria, the retention aid is cationic polyacrylamide.

According to the environmentally-friendly method for enhancing the mechanical properties of the high antibacterial nano dialysis paper for the medical protection, a surface sizing amount of the sizing agent is 10-15 g/m$^2$.

Compared with the prior art, in this application, the biodegradable and environment-friendly hardwood pulp, polyvinyl alcohol fiber, softwood pulp and cellulose fiber are used as the raw materials, and matching of fiber thickness is realized by optimizing a proportion of each component, so that a reasonable pore structure of the dialysis paper is constructed from a fiber network level, a pore size and a distribution range are controlled, and a required air permeability of a high-performance dialysis functional paper is ensured with a most basic raw material formula. According to the application, primary amino groups in modified chitosan molecules and aldehyde groups of the cellulose fiber are utilized to form a Schiff base structure and undergo an esterification reaction to increase a wet strength. In addition, a strong positive electricity of secondary amino groups on modified chitosan molecules may penetrate electronegative cell membranes of bacteria, so a chelation of the secondary amino groups and carboxyl groups with metal ions such as $Ca^{2+}$ and $Mg^{2+}$ (enzyme catalysts in a process of cell metabolism) in bacterial cells may play a bacteriostatic and bactericidal role. Therefore, a use of the modified chitosan in the dialysis functional paper may improve an antibacterial performance of the dialysis functional paper. Meanwhile, the polyvinyl alcohol fiber in the components according to the application may not affect a stability of a wet chemical system when the polyvinyl alcohol fiber is used as a paper surface enhancer, and may greatly improve the mechanical properties of the paper such as surface strength, water resistance, tensile strength and folding endurance, and may improve a physical strength of a high-performance dialysis functional paper. Moreover, the neutral size AKD of the sizing agent may directly react with active-OH groups on the cellulose fiber to generate firm β-ketoester covalent bonds under neutral or alkaline conditions, thus greatly enhancing a water resistance effect of paper samples and effectively preventing the bacteria from penetrating, making the paper samples have good antibacterial properties.

BRIEF DESCRIPTION OF THE DRAWINGS

FIG. 1 is a flowchart of an environmentally-friendly method for enhancing mechanical properties of a high antibacterial nano dialysis paper for medical protection according to the application.

DETAILED DESCRIPTION OF THE EMBODIMENTS

The application may be further illustrated with embodiments below, but the embodiments are not taken as a basis for limiting the application.

Embodiment 1: an environmentally-friendly method for enhancing mechanical properties of a high antibacterial nano dialysis paper for medical protection, including following steps:

a, preparing pulp components, taking 45 parts of hardwood pulp, 18 parts of polyvinyl alcohol fiber, 45 parts of softwood pulp and 12 parts of cellulose fiber by mass;

b, putting the hardwood pulp, the polyvinyl alcohol fiber, the softwood pulp and the cellulose fiber into a beater for beating to make a pulp, where a beating duration of the beater is 50 minutes, and a beating degree is 30° SR; using a ZQS2-23L beater in a laboratory for beating in this implementation, and selecting the beater according to actual needs in industry; then, adding modified chitosan accounting for 5% of a weight of the pulp, and defibering for 12 minutes at a rotating speed of 1600 revolutions per minute (rpm) in a defibrator, where the modified chitosan is prepared by an N-acylation reaction between maleic anhydride and chitosan under homogeneous conditions; adding 8 parts of chitosan to a mixture of 25 parts of N,N dimethylformamide and 30 parts of anhydrous ethanol by mass at a room temperature in this embodiment, stirring the mixture to dissolve the chitosan, and then adding 8 parts of maleic anhydride to the mixture, and finally obtaining a colloidal product by filtering after stirring for 12 hours, and washing the colloidal product to obtain modified chitosan; and c, carrying out papermaking with the pulp after defibering with a fourdrinier, surface sizing with a sizing agent, and drying to form a finished medical dialysis paper. The sizing agent is a mixture of a neutral size alkylketene dimmer (AKD), a wet strength agent and a retention aid, where a mass percentage of the neutral size AKD is 60%, a mass percentage of the wet strength agent is 25%, and a mass percentage of the retention aid is 15%; the wet strength agent is polyamide epichlorohydrin, with a solid content of 12.5%, and the wet strength agent is commercially available; the retention aid is cationic polyacrylamide, and the retention aid is commercially available, and a surface sizing amount of the sizing agent is 12 $g/m^2$.

Embodiment 2: an environmentally-friendly method for enhancing mechanical properties of a high antibacterial nano dialysis paper for medical protection, including the following steps:

a, preparing pulp components, taking 55 parts of hardwood pulp, 20 parts of polyvinyl alcohol fiber, 35 parts of softwood pulp and 15 parts of cellulose fiber by mass;

b, putting the hardwood pulp, the polyvinyl alcohol fiber, the softwood pulp and the cellulose fiber into the beater for beating to make a pulp, where the beating duration of the beater is 30 minutes, and the beating degree is 35° SR; using the ZQS2-23L beater in the laboratory for beating in this implementation, and selecting the beater according to actual needs in industry; then, adding modified chitosan accounting for 2% of a weight of the pulp, and defibering for 18 minutes at the rotating speed of 1800 rpm in the defibrator, where the modified chitosan is prepared by an N-acylation reaction between maleic anhydride and chitosan under homogeneous conditions; adding 5 parts of chitosan to a mixture of 20 parts of N,N dimethylformamide and 25 parts of anhydrous ethanol by mass at the room temperature in this embodiment, stirring the mixture to dissolve the chitosan, and then adding 10 parts of maleic anhydride to the mixture, and finally obtaining a colloidal product by filtering after stirring for 15 hours, and washing the colloidal product to obtain modified chitosan; and c, carrying out papermaking with the pulp with the fourdrinier, surface sizing with a sizing agent, and drying to form a finished medical dialysis paper. The sizing agent is a mixture of a neutral size AKD, a wet strength agent and a retention aid; a mass percentage of the neutral size AKD is 75% with a solid content of more than 15%, a mass percentage of the wet strength agent is 10%, and a mass percentage of the retention aid is 15%; the wet strength agent is polyamide epichlorohydrin, with a solid content of 12.5%, the retention aid is cationic polyacrylamide, and a surface sizing amount of the sizing agent is 15 $g/m^2$.

Embodiment 3: an environmentally-friendly method for enhancing mechanical properties of a high antibacterial nano dialysis paper for medical protection, including the following steps:

a, preparing pulp components, taking 50 parts of hardwood pulp, 15 parts of polyvinyl alcohol fiber, 40 parts of softwood pulp and 15 parts of cellulose fiber by mass;

b, putting the hardwood pulp, the polyvinyl alcohol fiber, the softwood pulp and the cellulose fiber into the beater for beating to make a pulp, where the beating duration of the beater is 45 minutes, and the beating degree is 33° SR; using the ZQS2-23L beater in the laboratory for beating in this implementation, and selecting the beater according to actual needs in industry; then, adding modified chitosan accounting for 3% of a weight of the pulp, and defibering for 15 minutes at the rotating speed of 1800 rpm in the defibrator, where the modified chitosan is prepared by an N-acylation reaction between maleic anhydride and chitosan under homogeneous conditions; adding 8 parts of chitosan to a mixture of 30 parts of N,N dimethylformamide and 30 parts of anhydrous ethanol by mass at the room temperature in this embodiment, stirring the mixture to dissolve the chitosan, and then adding 7 parts of maleic anhydride to the mixture, and finally obtaining a colloidal product by filtering after stirring for 14 hours, and washing the colloidal product to obtain modified chitosan; and c, carrying out papermaking with the pulp with the fourdrinier, surface sizing with a sizing agent, and drying to form a finished medical dialysis paper. The sizing agent is a mixture of a neutral size AKD, a wet strength agent and a retention aid, where a mass percentage of the neutral size AKD is 70%, the solid content is more than 15%, a mass percentage of the wet strength agent is 15%, and a mass percentage of the retention aid is 15%; the wet strength agent is polyamide epichlorohydrin with a solid content of 12.5%, the retention aid is cationic polyacrylamide, and a surface sizing amount of the sizing agent is 15 g/m$^2$.

Embodiment 4: an environmentally-friendly method for enhancing mechanical properties of a high antibacterial nano dialysis paper for medical protection, including the following steps:

a, preparing pulp components, taking 55 parts of hardwood pulp, 18 parts of polyvinyl alcohol fiber, 35 parts of softwood pulp and 12 parts of cellulose fiber by mass;

b, putting the hardwood pulp, the polyvinyl alcohol fiber, the softwood pulp and the cellulose fiber into the beater for beating to make a pulp, where the beating duration of the beater is 40 minutes, and the beating degree is 30° SR; using the ZQS2-23L beater in the laboratory for beating in this implementation, and selecting the beater according to actual needs in industry; then, adding modified chitosan accounting for 1% of a weight of the pulp, and defibering for 12 minutes at the rotating speed of 2000 rpm in the defibrator, where the modified chitosan is prepared by an N-acylation reaction between maleic anhydride and chitosan under homogeneous conditions; adding 10 parts of chitosan to a mixture of 40 parts of N,N dimethylformamide and 20 parts of anhydrous ethanol by mass at the room temperature in this embodiment, stirring the mixture to dissolve the chitosan, and then adding 5 parts of maleic anhydride to the mixture, and finally obtaining a colloidal product by filtering after stirring for 15 hours, and washing the colloidal product to obtain modified chitosan; and c, carrying out papermaking with the pulp with the fourdrinier, surface sizing with a sizing agent, and drying to form a finished medical dialysis paper. The sizing agent is a mixture of a neutral size AKD, a wet strength agent and a retention aid, where the neutral size AKD has a mass percentage of 80% and a solid content of more than 15%, a mass percentage of the wet strength agent is 15%, and a mass percentage of the retention aid is 5%; the wet strength agent is polyamide epichlorohydrin with a solid content of 12.5%, and the retention aid is cationic polyacrylamide, and a surface sizing amount of the sizing agent is 10 g/m$^2$.

Embodiment 5: an environmentally-friendly method for enhancing mechanical properties of a high antibacterial nano dialysis paper for medical protection, including the following steps:

a, preparing pulp components, taking 50 parts of hardwood pulp, 13 parts of polyvinyl alcohol fiber, 36 parts of softwood pulp and 14 parts of cellulose fiber by mass;

b, putting the cellulose fiber, the cellulose mercerized fiber, the viscose fiber and the polylactic acid fiber into the beater for beating to make a pulp, where the beating duration of the beater is 60 minutes, and the beating degree is 35° SR; using the ZQS2-23L beater in the laboratory for beating in this implementation, and selecting the beater according to actual needs in industry; then, adding modified chitosan accounting for 3% of a weight of the pulp, and defibering for 15 minutes at the rotating speed of 2000 rpm in the defibrator, where the modified chitosan is prepared by an N-acylation reaction between maleic anhydride and chitosan under homogeneous conditions; adding 10 parts of chitosan to a mixture of 20 parts of N,N dimethylformamide and 20 parts of anhydrous ethanol by mass at the room temperature in this embodiment, stirring the mixture to dissolve the chitosan, and then adding 10 parts of maleic anhydride to the mixture, and finally obtaining a colloidal product by filtering after stirring for 13 hours, and washing the colloidal product to obtain modified chitosan; and c, carrying out papermaking with the pulp with the fourdrinier, surface sizing with the sizing agent, and drying to form a finished medical dialysis paper. The sizing agent is a mixture of a neutral size AKD, a wet strength agent and a retention aid, where the neutral size AKD has a mass percentage of 70% and a solid content of more than 15%, a mass percentage of the wet strength agent is 10%, and a mass percentage of the retention aid is 20%; the wet strength agent is polyamide epichlorohydrin with a solid content of 12.5%, the retention aid is cationic polyacrylamide, and a surface sizing amount of the sizing agent is 12 g/m$^2$.

Comparative example: domestic dialysis paper on the market.

Antibacterial test of dialysis paper

Strain culture: preparing multiple culture media to culture Bacillus subtilis under same conditions, and diluting the cultured strain to 107 cfu/ml; cutting the dialysis papers prepared in embodiments 1-5 and a dialysis paper in comparative example into 5 cm squares and sterilizing for a later use; transferring sterilized samples to sterile plates, taking 5 drops of Bacillus subtilis suspension with 107 cfu/ml with 0.1 ml per drop, and evenly dropping the suspension on outer surfaces of the samples without touching each other, and drying the samples for 6-16 hours at 20-25° C. and a 40-50% relative humidity; completely spreading inner surfaces of the contaminated samples on surfaces of nutrient agar media after drying, and discard the samples after 5-6 seconds; culturing the nutrient agar media at 37° C. , and then observing a growth of bacteria at two time points of 24 hours and 15 days, and recording a number of grown bacteria in a record table of antibacterial paper sample detection. Results are shown in a following table.

TABLE 1

| | Number of Bacillus subtilis/cell (24 h) | Number of Bacillus subtilis/cell (15 D) |
|---|---|---|
| Embodiment 1 | 0 | 403 |
| Embodiment 2 | 0 | 423 |
| Embodiment 3 | 0 | 395 |
| Embodiment 4 | 0 | 415 |
| Embodiment 5 | 0 | 426 |
| Comparative example | 115 | 3356 |

As may be seen from Table 1, the dialysis papers prepared by the application have a good antibacterial performance, and may achieve a complete antibacterial effect within 24 hours, while a number of Bacillus subtilis may be generated in the comparative example. At the time point of 15 days, the number of Bacillus subtilis in the dialysis papers prepared by the application is far less than that of the conventional dialysis paper in the comparative example, further showing that the dialysis papers according to the application have the good antibacterial performance, and process parameters in embodiment 3 may achieve an optimal technical effect.

Further, an applicant uses isopropyl alcohol (IPA) as a wetting agent, and testes pore structures of the dialysis papers in embodiments 1-5 and comparative example of the application by a bubble point method through an aperture meter. Results are shown in Table 2 below.

TABLE 2

| | Maximum aperture um | Minimum aperture um | Average aperture um |
|---|---|---|---|
| Embodiment 1 | 17.56 | 1.32 | 7.01 |
| Embodiment 2 | 17.65 | 1.15 | 7.21 |
| Embodiment 3 | 17.24 | 1.04 | 6.86 |
| Embodiment 4 | 17.32 | 1.25 | 7.14 |
| Embodiment 5 | 17.45 | 1.45 | 6.95 |
| Comparative example | 26.87 | 5.78 | 16.72 |

As may be seen from Table 2, the biodegradable and environment-friendly hardwood pulp, polyvinyl alcohol fiber, softwood pulp and cellulose fiber are used as raw materials, and matching of fiber thickness is realized by optimizing a proportion of each component, so that a reasonable pore structure of the dialysis paper is constructed from a fiber network level, a pore size and a distribution range are controlled, and a required air permeability of a high-performance dialysis functional paper is ensured with a most basic raw material formula.

Furthermore, the applicant testes the mechanical properties of the dialysis papers in embodiments 1-5 and comparative example. The mechanical properties include tensile strength, tearing degree, dry bursting index and wet bursting index, in which the tensile strength is measured by a DCP-KZ300A (R) computer of Sichuan Changjiang Paper Instrument Co., Ltd., and a tensile testing machine is operated with reference to a national standard GB/T 453-1989 and converted into a tensile index. The tearing degree is measured by a DCP-SLY 16K computer measuring and controlling tearing degree instrument of Sichuan Changjiang Paper Instrument Co., Ltd. with reference to a national standard GB/T455-2002, and converted into a tearing index. The dry bursting index and the wet bursting index were determined by an international standard ISO "Method for Determination of Bursting Resistance of Cardboard", and results are shown in Table 3.

TABLE 3

| | Tensile index N · m/g | Tearing index m N · $m^3$/g | Dry bursting index kPa · $m^3$/g | Wet bursting index |
|---|---|---|---|---|
| Embodiment 1 | 64.8 | 16.4 | 4.73 | 1.81 |
| Embodiment 2 | 65.7 | 16.8 | 4.75 | 1.85 |
| Embodiment 3 | 68.4 | 17.5 | 4.85 | 1.90 |
| Embodiment 4 | 66.5 | 17.0 | 4.81 | 1.87 |
| Embodiment 5 | 63.5 | 17.2 | 4.79 | 1.85 |
| Comparative example | 36.6 | 10.5 | 3.86 | 0.91 |

As may be seen from Table 3, the dialysis papers prepared by this application have good mechanical properties, and the tensile index, the tearing index, the dry bursting index and the wet bursting index are all increased by about one time compared with the comparative example, and the dry bursting index and the wet bursting index reach performance standards of dialysis papers produced abroad (the dry bursting index of foreign dialysis papers may reach above 4.5 kPa·$m^2$/g, and the wet bursting index may reach 1.8 kPa·$m^2$/g), so the dialysis papers reach an international leading level and have good competitiveness.

To sum up, in this application, the biodegradable and environment-friendly hardwood pulp, polyvinyl alcohol fiber, softwood pulp and cellulose fiber are used as the raw materials, and the matching of fiber thickness is realized by optimizing the proportion of each component, so that the reasonable pore structure of the dialysis paper is constructed from the fiber network level, the pore size and the distribution range are controlled, and the required air permeability of the high-performance dialysis functional paper is ensured with the most basic raw material formula. According to the application, primary amino groups in modified chitosan molecules and aldehyde groups of the cellulose fiber are utilized to form a Schiff base structure and undergo an esterification reaction to increase a wet strength. In addition, a strong positive electricity of secondary amino groups on modified chitosan molecules may penetrate electronegative cell membranes of bacteria, so a chelation of the secondary amino groups and carboxyl groups with metal ions such as $Ca^{2+}$ and $Mg^{2+}$ (enzyme catalysts in a process of cell metabolism) in bacterial cells may play a bacteriostatic and bactericidal role. Therefore, a use of the modified chitosan in the dialysis functional paper may improve an antibacterial performance of the dialysis functional paper. Meanwhile, the polyvinyl alcohol fiber in the components according to the application may not affect a stability of a wet chemical system when the polyvinyl alcohol fiber is used as a paper surface enhancer, and may greatly improve the mechanical properties of the paper such as surface strength, water resistance, tensile strength and folding endurance, and may improve the physical strength of the high-performance dialysis functional paper. Moreover, the neutral size AKD of the sizing agent may directly react with active-OH groups on the cellulose fiber to generate firm β-ketoester covalent bonds under neutral or alkaline conditions, thus greatly enhancing a water resistance effect of paper samples and effectively preventing the bacteria from penetrating, making the paper samples have good antibacterial properties.

What is claimed is:

1. An environmentally-friendly method for enhancing mechanical properties of a high antibacterial nano dialysis paper for medical protection, comprising following steps:

a, preparing pulp components, wherein 40-60 parts of hardwood pulp, 10-20 parts of polyvinyl alcohol fiber, 30-50 parts of softwood pulp and 10-20 parts of cellulose fiber by mass are taken;

b, putting the hardwood pulp, the polyvinyl alcohol fiber, the softwood pulp and the cellulose fiber into a beater for beating to make a pulp, and then adding modified chitosan accounting for 1-5% of a weight of the pulp into the pulp, and then defibering for 10-20 minutes at a rotating speed of 1500-2000 revolutions per minute in a defibrator; and c, carrying out papermaking with the pulp after defibering to form a dialysis paper finished product;

wherein the modified chitosan is prepared by an N-acylation reaction between maleic anhydride and chitosan under homogeneous conditions:

adding 5-10 parts of chitosan to a mixture of 20-40 parts of N,N dimethylformamide and 20-40 parts of anhydrous ethanol by mass at a room temperature, stirring the mixture to dissolve the chitosan, and then adding 5-10 parts of maleic anhydride to the mixture, and finally obtaining a colloidal product by filtering after stirring for 12-15 hours, and washing the colloidal product to obtain the modified chitosan.

2. The environmentally-friendly method for enhancing the mechanical properties of the high antibacterial nano dialysis paper for the medical protection according to claim 1, wherein in the step a, the pulp components comprise 50 parts of hardwood pulp, 15 parts of polyvinyl alcohol fiber, 40 parts of softwood pulp and 15 parts of cellulose fiber.

3. The environmentally-friendly method for enhancing the mechanical properties of the high antibacterial nano dialysis paper for the medical protection according to claim 1, wherein in the step b, a beating duration of the beater is 30-60 minutes, and a beating degree is 30-35° SR.

4. The environmentally-friendly method for enhancing the mechanical properties of the high antibacterial nano dialysis paper for the medical protection according to claim 1, wherein in the step c, carrying out papermaking with the pulp with a fourdrinier, surface sizing with a sizing agent, and drying to form a finished medical dialysis paper, wherein the sizing agent is a mixture of a neutral size alkylketene dimmer (AKD), a wet strength agent and a retention aid, a mass percentage of the neutral size AKD is 60%-80%, a mass percentage of the wet strength agent is 10%-20%, and a mass percentage of the retention aid is 10%-20%.

5. The environmentally-friendly method for enhancing the mechanical properties of the high antibacterial nano dialysis paper for the medical protection according to claim 4, wherein a mass percentage of the neutral size AKD in the sizing agent is 70%, a mass percentage of the wet strength agent is 15%, and a mass percentage of the retention aid is 15%.

6. The environmentally-friendly method for enhancing the mechanical properties of the high antibacterial nano dialysis paper for the medical protection according to claim 4, wherein the wet strength agent is polyamide epichlorohydrin, with a solid content of 12.5%.

7. The environmentally-friendly method for enhancing the mechanical properties of the high antibacterial nano dialysis paper for the medical protection according to claim 4, wherein the retention aid is cationic polyacrylamide.

8. The environmentally-friendly method for enhancing the mechanical properties of the high antibacterial nano dialysis paper for the medical protection according to claim 4, wherein a surface sizing amount of the sizing agent is 10-15 $g/m^2$.

* * * * *